United States Patent [19]

Mikina

[11] 4,212,163

[45] Jul. 15, 1980

[54] HEAT ENGINE

[76] Inventor: Stanley J. Mikina, 4782 Coquina Key Dr., St. Petersburg, Fla. 33705

[21] Appl. No.: 915,907

[22] Filed: Jun. 16, 1978

[51] Int. Cl.[2] ..... F02G 3/02

[52] U.S. Cl. ..... 60/39.63; 91/188; 91/273; 137/624.17; 137/624.2

[58] Field of Search ..... 60/39.63, 39.62, 39.6, 60/39.69, 39.66; 91/264, 188, 187, 273, 183, 448; 137/624.17, 624.2

[56] References Cited

U.S. PATENT DOCUMENTS

| | | | |
|---|---|---|---|
| 1,622,010 | 3/1927 | Summer | 60/39.62 |
| 1,755,846 | 4/1930 | Steed | 60/39.66 |
| 1,960,810 | 5/1934 | Gordon | 60/39.66 X |
| 2,051,534 | 8/1936 | Skwierawski | 91/273 |
| 2,390,716 | 12/1945 | Kelly | 91/273 X |
| 2,688,230 | 9/1954 | Milliken | 60/39.63 |
| 2,946,346 | 7/1960 | Mead | 137/624.17 X |
| 3,577,729 | 5/1971 | Warren | 60/39.63 |
| 3,651,641 | 3/1972 | Ginter | 60/39.63 X |
| 3,932,987 | 1/1976 | Munzinger | 60/39.63 X |

*Primary Examiner*—Robert E. Garrett
*Assistant Examiner*—Edward Look
*Attorney, Agent, or Firm*—William J. Ruano

[57] ABSTRACT

A heat engine which the steady burning of liquid or gaseous fuel in a combustion chamber, external to the engine cylinders, is converted to mechanical work by means of expansion of the combustion gases in the engine cylinders. A pair of series inlet poppet valves is provided per engine cylinder so phased to provide a short interval period of gas admission to each cylinder for making the expansion ratio substantially equal to the compression ratio for maximum efficiency. The poppet valves, whose angular interval when they are both open are varied by an amount inversely proportional to the combustor pressure. The gas pressure forces acting on the poppet valves are counterbalanced to permit their actuation by conventional cams and valve gear without excessive cam loads and wear.

12 Claims, 6 Drawing Figures

HEAT ENGINE

My invention relates to the field of heat engines, in which the steady burning of a liquid or gaseous fuel in a combustion chamber, external to the engine cylinders, is converted to mechanical work by means of expansion of the combustion gases in the engine cylinders.

It is the object of my invention to effect this energy conversion through fundamental improvements in the embodiment of the classical Joule cycle for a hot gas engine. By virtue of these fundamental improvements, the following objectives of my invention are attained: (a) high thermal efficiency; (b) nearly perfect combustion, with no air pollutants in the exhaust; (c) ability to burn any fluid fuel, including crude oil; (d) simple control of the engine power output; (e) easy starting with a battery energized electric starter motor; (f) quiet operation due to absence of explosive combustion but instead with steady continuous burning of the fuel in a combustion chamber external to the engine cylinders.

Figure 1:
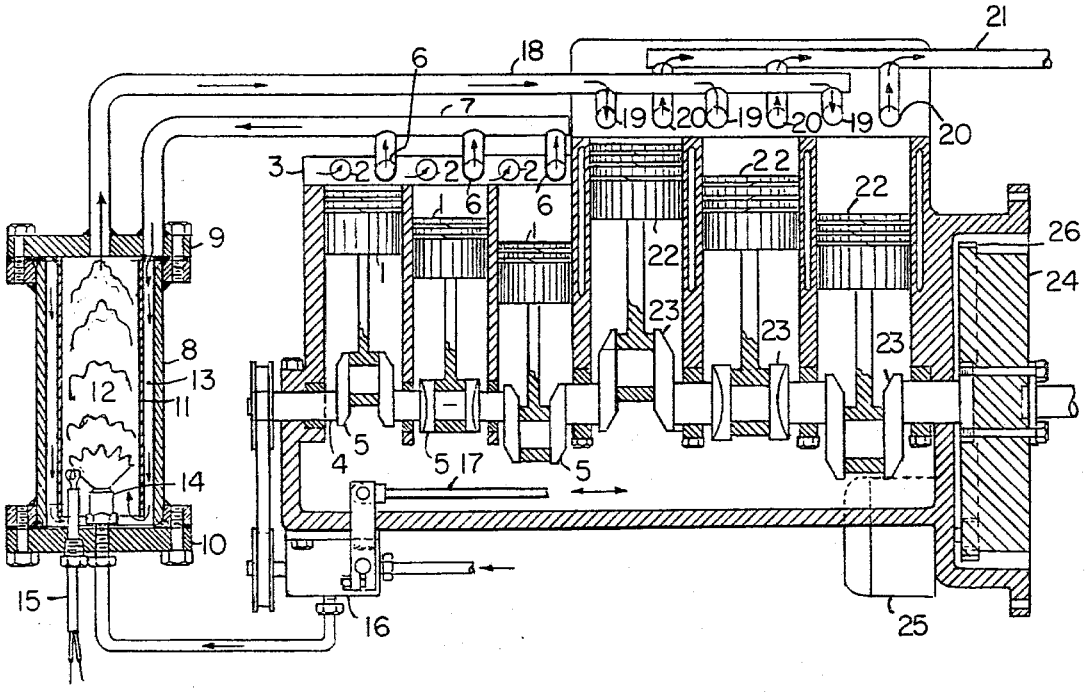
Figure 2:
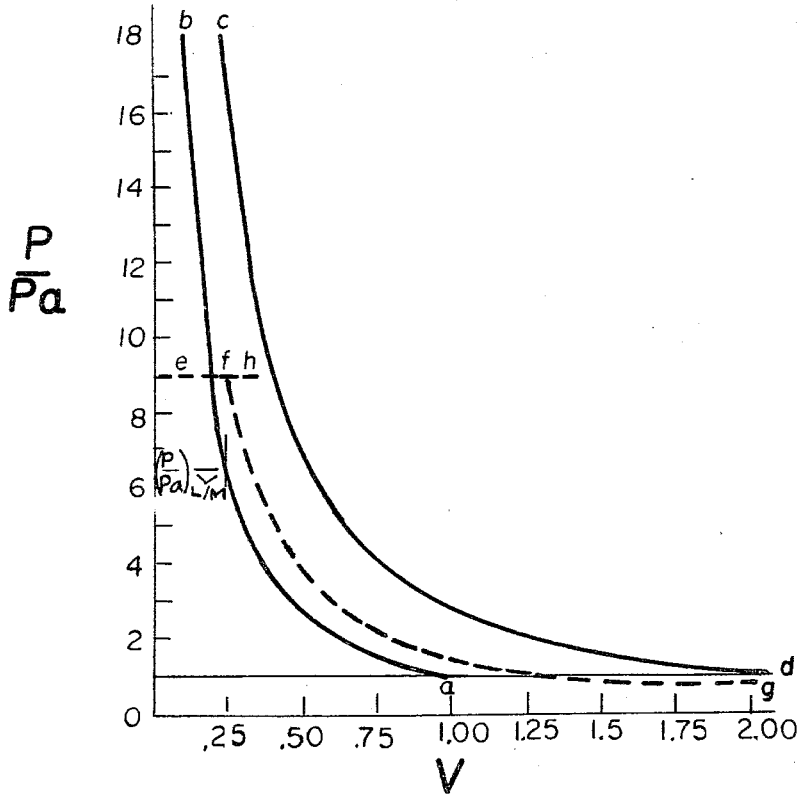
Figure 4:
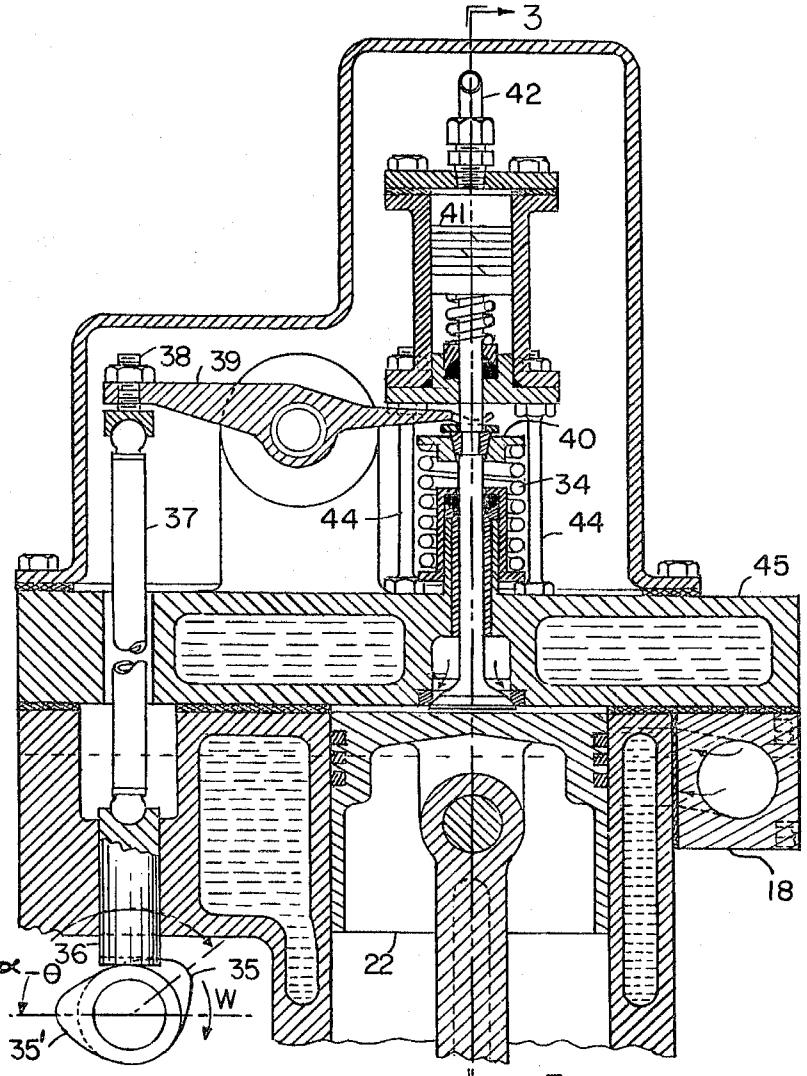
Figure 3:
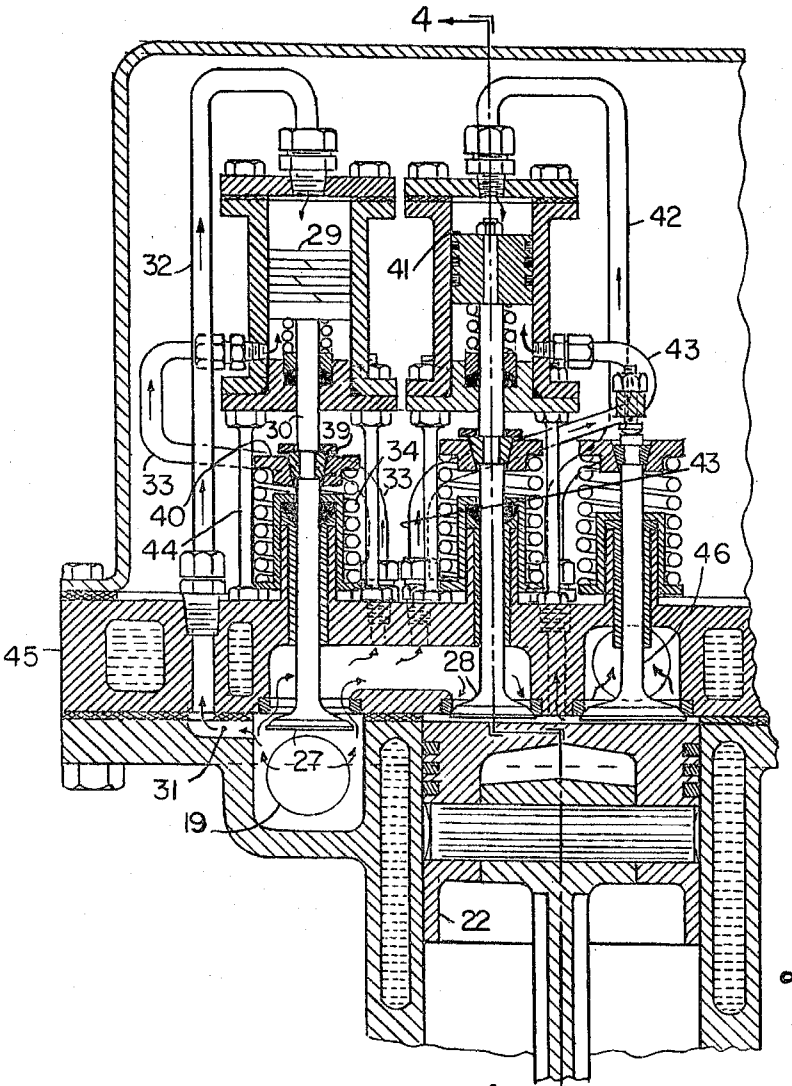
Figure 5:
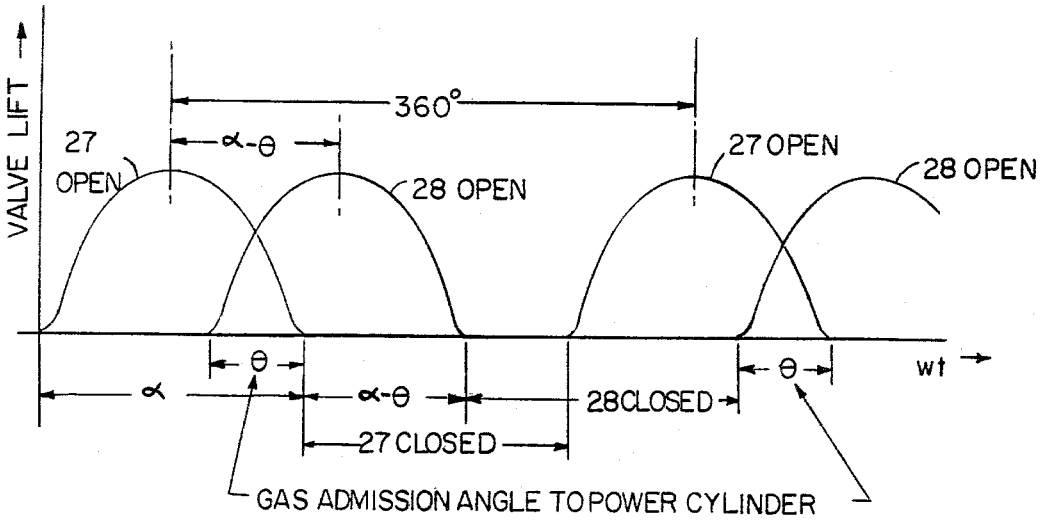
Figure 6:
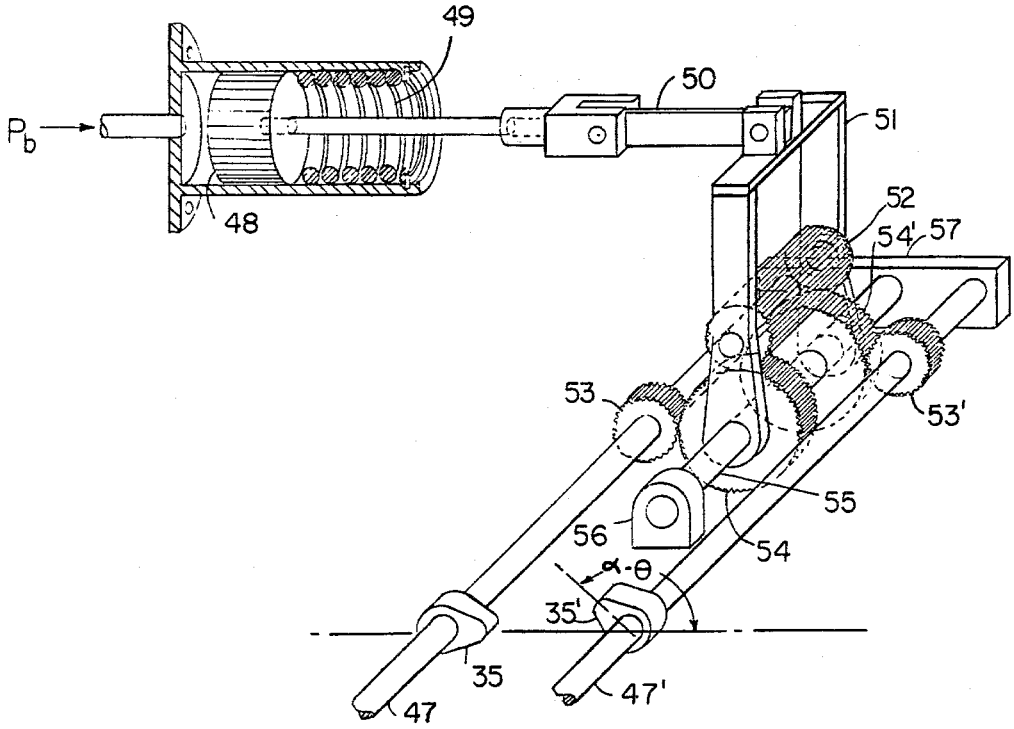

These and other objects of my invention will become more apparent from the following description taken with the accompanying drawing wherein:

FIG. 1 is a vertical cross-section view of a schematic layout of the engine components, comprising, in this embodiment, a three cylinder piston type compressor, a three cylinder engine for driving the compressor and for providing a net power output, an external combustion chamber for supplying hot gases to the power cylinders; associated engine valves, a fuel pump, and a starter motor;

FIG. 2 is a graph showing the Joule cycle diagram on pressure-volume coordinates, consisting of a near adiabatic compression of air, fuel burning and gas expansion at substantially constant pressure, accurate cut-off of the combustion gases at a predetermined point in the cycle, a near adiabatic expansion of the combustion gases to atmospheric pressure, ending with exhaust of the spent gases to the atmosphere;

FIGS. 3 and 4 are fragmentary, vertical cross-sectional views showing the heart of my invention, and show the means for using high temperature resistant poppet valves for accurate cut-off of inlet without destructive valve accelerations and with smooth operation of the inlet valves by conventional cams;

FIG. 5 is a graph which shows the basic relations between the two time-phased inlet valve per power cylinder that make possible the solution of the accurate cut-off problem; and FIG. 6 is a perspective view which shows a means for continuously varying the inlet valve cut-off interval in response to the combustor pressure level, so as to provide optimal valve phase for maximum thermal efficiency at all combustor pressure levels.

A detailed description of each figure follows:

Referring more particularly to the schematic showing of FIG. 1, my embodiment of the classical Joule hot gas cycle is designed to be readily applicable to automotive vehicle propulsion as well as for use as a stationary engine in other applications. I have attempted to create an engine of great reliability by means of the utmost simplicity in its basic configuration. Its thermodynamic cycle begins with the inspiration of atmospheric air by the compressor pistons 1 through intake ports 2 and associated reed valves in the compressor cylinder head 3. In the engine embodiment of FIG. 1, three compressor cylinders are shown, with their pistons 1 driven by a crankshaft 4 with its crank throws 5 spaced 120° apart for greater uniformity in compressor output. In a typical automotive application, the compressor pistons are 4 inches diameter ×3.2 inches stroke, and the peak discharge pressure at the steady state design point is 250 psig. with a volume compression ratio of 8.

The compressed air is discharged through reed valves and exit ports 6 in the cylinder head and into a discharge manifold 7 leading to the external combustor assembly. This unit consists of an outer cylindrical pressure vessel 8 whose ends are closed off with gasketed flanged caps 9 and 10, and an inner cylindrical burner shell 11 that is welded to upper flange plate 9. Shell 11 extends to within a ¼ inch or so of the bottom flange plate 10, and surrounds the combustion zone 12 while forming an annular flow channel 13 that serves to preheat the compressed air that enters the pressure vessel through pipe 7 in plate 9. Although the compressor air is heated to about 700° F. from an initial 70° F. by the near adiabatic compression, it can also serve as a cooling medium for protecting the pressure vessel walls 8 from the much higher temperatures in the combustion zone 12.

The preheated compressed air at 250 psig. enters the combustion zone through the annular axial clearance gap of ¼ inch or so between shell 11 and bottom flange cover 10. There it mixes with the burning fuel spray issuing from fuel nozzle 14 and supports its combustion. The combustion flame is initiated by a glow plug 15 or by a solid state spark type igniter similar to those used on domestic oil burning heating furnaces.

With a steady flow of air and fuel into the combustion chamber, the fuel burns with a steady continuous flame that can result in nearly perfect combustion of all the combustible elements in the fuel-air mixture. This burning process takes place at a substantially constant pressure equal to the compressor discharge pressure. In the steady state the combustor pressure cannot increase because the mass of combustion products leaving the combustor is exactly equal to the mass of air plus fuel entering the combustor.

Since the fuel must be admitted to the combustion chamber against the comparatively high pressure there, it must be pumped in by a positive displacement piston or vane type pump 16 that is driven from the engine crankshaft. This pump must be of the variable displacement type, so that the engine power output can be controlled by rod or cable 17 that controls the fuel pump output per revolution.

To insure nearly complete combustion, two important requirements must be met by the combustor system: (1) excess air for combustion and (2) sufficient combustor volume.

(1) Excess air. A plentiful supply of air must be provided by the compressor in relation to the quantity of fuel that is pumped in per revolution of the engine. This requirement is automatically satisfied by limiting the maximum fuel rate per revolution, since air 100% to 175% in excess of that required for complete combustion must be supplied to keep the leaving temperatures of the products of combustion from exceeding about 1850° F., which is near the limit of temperature resistance of the engine poppet valves if satisfactory valve life is to be realized. Combustion gases undiluted with excess air can easily reach temperatures of the order of 4500° F.

(2) Combustor Volume. The remaining requirement for complete combustion is to provide sufficient combustor volume in order to insure adequate dwell time of the fuel-air mixture for burning to go to completion before the combustion products leave to enter the engine cylinders. In this engine, in contrast to the internal combustion engine, there is no severe limitation on available combustion time, as it is not tied inexorably to the short interval of half a revolution of the engine, which can be as short as 1/100 second or less.

A guide to the propoer combustor volume is provided by the pressure-volume diagram of the system cycle shown in FIG. 2. In this diagram, the gas pressure is plotted on the vertical axis in non-dimensional form as the ratio of pressure to atmospheric pressure $P/P_a$, while the gas volume is plotted along the horizontal axis in non-dimensional form as the ratio of volume to compressor volume, or $V/V_a$. In the idealized diagram that neglects valve pressure drops and heat losses, air is sucked into the compressor cylinders along the line 1-a, is next compressed adiabatically to discharge pressure along the line a-b. It is then discharged into the combustor along the line b-18, where it is heated at constant pressure and is admitted to the engine cylinders along the line 18-c. At c the engine inlet valves close with a sharp cut-off, and the gas expansion proceeds down to atmospheric pressure along the adiabatic line c-d as the engine pistons descend to bottom dead center. For the 8 to 1 volume compression ratio of the engine model of FIG. 1, the volume at b($V_b$) is equal to about one-eighth of the compressor volume $V_a$ (all three cylinders), while the expanded volume $V_c$ for a gas temperature of 1850° F. is about one-quarter of the compressor volume $V_a$. Thus by making the combustor volume equal to $10V_b$, or 10/8 × compressor volume, the combustor volume will be equal to 5 times the expanded gas volume at point c. This will give a gas residence or dwell time in the combustor of about 5 revolutions of the engine, or an available combustion time equal to about 10 times that in a conventional four-cycle engine, which should be sufficient for nearly complete combustion. For three 4 inch diameter × 3.2 inch stroke compressor cylinders, the required volume of combustor shell 11 is 151 cubic inch, or 4.5 inch diameter × 9.5 inch length.

The combustion gases leave the combustor pressure vessel and enter the engine cylinders through intake manifold 18 and ports 19 and associated inlet poppet valves. The spent gases are discharged from the engine through poppet valves to ports 20 and exhaust manifold 21.

The power producing part of the engine consists in this example of three cylinders whose pistons 22 drive a crankshaft coupled to or integral with the compressor crankshaft 4. The crank pin throws 23 are spaced angularly 120° apart and are preferably so phased with respect to the compressor pistons 1 that a power piston is starting its power stroke at top dead center at the same time that a compressor piston is starting its compression stroke at bottom dead center. This three cylinder engine is equivalent to a six cylinder four-cycle engine, since there is a power stroke per revolution per cylinder. A flywheel 24 reduces the engine speed variations due to inherent variations of engine torque below and above the average output torque.

The proper power cylinder size in relation to the coupled compressor cylinder size can be determined with the aid of the PV diagram of FIG. 2. There the work per cycle required to drive the compressor at a volume compression ratio of 8 to 1 is represented by the area bounded by the lines 1-a,a-b,b-18, and the vertical P/Pa axis. The work developed by the engine cylinders per cycle is represented by the area bounded by the lines 1-d,d-c,c-18, and the vertical P/Pa axis. The difference between the engine and compressor work areas represents the net work output of the engine per cycle, and is depicted by the area bounded by the lines whose corners are the points abcd, that is the area between the two adiabatic curves of compression and subsequent expansion.

In order to achieve the maximum thermal efficiency that this engine is capable of with a given compression ratio, it is necessary to size the engine cylinders so that the expansion ratio in the engine is equal to the compression ratio in the compressor. This will insure that the adiabatic expansion along the line c-d will cause the point d of cylinder pressure to reach atmospheric pressure at bottom dead center of the engine piston, thus extracting all of the available energy from the combustion gases before the utterly spent gases are discharged into the atmosphere. The requirement for maximum thermal efficiency is thus expressed by the following volume ratios: $V_d/V_a = V_c/V_b$. The volume at c in relation to the volume at b is determined by the allowable leaving absolute temperature of the combustion gases, in relation to the absolute temperature of the compressed air at point b. Since the compressed air temperature at b is about 700° F., and the maximum permissible temperature of the leaving combustion gases is around 1860° F., it follows that:

$$V_c/V_b = (1860+460)/(700+460) = 2 = V_d/V_a$$

This relation is satisfied by making the engine cylinders of 5 inches diameter × 4.1 inches stroke.

The above engine model, which is of a configuration and size suitable for automotive vehicle propulsions, has a theoretical output of 60 hp at 3000 r.p.m. with an air-standard thermal efficiency of 55.6%. One can confidently expect that with this external combustion engine, a much larger fraction of the available hot gas energy will be converted to work than in the conventional four-cycle machine, for three principal reasons: (1) complete combustion (2) complete extension and (3) lower friction horsepower due to absence of explosive pressure loads and vibrations.

Another nice feature of this engine is that its compression ratio is not limited by considerations of preignition or detonation as in the case in the four-cycle internal combustion engine. Thus, raising the volume compression ratio to 20 will increase the air-standard thermal efficiency to 70%. Still higher compression ratios and efficiencies are only limited by the acceptable compressor and valve complexity and cost but not by thermodynamic considerations.

One other aspect of this engine that needs description now is its performance at starting, whether for vehicle applications or as a stationary engine. In FIG. 1, a conventional battery operated starter motor 25 is shown. Its pinion engages a ring gear 26 or flywheel 24 and cranks the engine until the engine rotation is self-maintained by its net positive power output. At starting, the sequence of engine operations is as follows: From a cold start the combustor pressure is atmospheric and the starter motor does not do much air compressing but only overcomes low engine friction. Referring to FIG. 2, it is seen that initially ¾ of the compressor air delivery accumulates in the combustor, with ¼ going to the engine cylinders due to the cut-off valve action, thus causing the combustor pressure to rise. At a pressure ratio of 6.5, all of the air delivered to the combustor would be passed on to the engine if there were no air heating. With combustion, the air mass in the combustor continues to increase and a net power output from the engine begins to be developed. This will occur after about 10 revolutions of the engine from start. For example, when the pressure ratio reaches 9, the air volume discharged to the combustor is represented by the horizontal line e-9 on the cycle diagram. The products of combustion will increase in volume to a point h, but only the volume 9-f is admitted to the engine cylinders. As this admitted gas expands along the dashed adiabatic line f-g, the engine develops a net output work per cycle represented by the area bounded by the adiabatic compression line a-e and the expansion line f-g. So from a pressure ratio of about 6.5 to 7, the engine rotation is self-maintained. The excess gas volume f-h that is not admitted to the engine because of the cut-off valve action goes to increasing the combustor pressure. As the fuel delivery per cycle is increased, the combustor pressure and the engine power output will continue to rise until the steady state full power condition of $P/P_a=18$ is reached and all of the air+fuel mass pumped into the combustor is admitted to the engine cylinders along the line 18-c.

We now come to the most important part of my invention, and that is the cut-off valve system that permits complete gas expansion to be realized for highest engine thermal efficiency. In FIG. 2, the volume $V_c$ is one-quarter of the compressor volumetric displacement and one-eighth of the volumetric displacement of the engine cylinders. With an engine stroke of 4.1 inches, this means that the engine inlet valves must close when an engine piston has moved down from top dead center a distance of 4.1/8 or 0.5125 inches to provide the required sharp cut-off of gas admission. During this interval, the crankshaft has turned through an angle of approximately 41°.

One indispensible requirement for the admission valve system is therefore that it operate reliably in the very short interval represented by a crankshaft or camshaft angular travel of 41°. The other requirement is that the valve system be capable of metering the combustor gases at the high temperature of about 1850° F. with satisfactory valve life.

The resulting valve problem posed by these requirements is this: The only valve capable of withstanding these high gas temperatures without excessive deterioration is the familiar poppet valve as used presently in internal combustion engines. But this poppet valve cannot be actuated by a cam that would operate over 41° cam travel without destructive accelerations and loads that would quickly destroy the cam and cam follower surfaces at higher engine speeds. The only valve system hitherto available for such cut-off duty is the classical D slide valve used in steam engine technology. But the slide valve is not capable of operating without excessive friction, wear, and leakage at the high gas temperature of 1850° F.

I have solved this valve problem by using two poppet valves in series which are displaced in phase relative to each other, as shown in FIGS. 3, 4, 5 and 6, thereby avoiding the problem of destructive accelerations with cam actuation.

Referring first to FIGS. 3 and 4, these show my valve system as applied to a single engine cylinder. Hot combustor gas enters through port 19 and into a cavity below the first inlet poppet valve 27. Valve 27 is actuated by a cam of conventional shape and remains open for approximately half a revolution of the cam shaft. However, the gas flowing through valve 27 goes into a connecting pressure that leads to the second inlet valve 28, and thus cannot enter the engine cylinder until valve 28 is open. Valve 28 is actuated by a cam of conventional shape and also remains open for about half a revolution of the camshaft. However, when valve 28 stays open beyond the 41° camshaft and crankshaft angular displacement from top dead center, then valve 27 is closed and maintains the required admission cut-off for the rest of the expansion stroke.

This inlet valve phasing is graphically illustrated in FIG. 5. Thus, without exceeding the allowable valve accelerations, very short and sharply defined cut-off intervals of gas admission to the engine can be obtained by this simple expedient of inlet series valve phasing. This novel concept enables the hitherto obsolute classical Joule hot gas cycle to be applied to modern use and full advantage taken of its potential for high thermal efficiency with resulting economies in terms of reduced fuel consumption and absence of air polution.

To make the poppet valve truly practical for this application, one other expedient is required, and that is valve balancing. Valve 27, for example, has to open against the full combustor gas pressure acting on its lower exposed face. To avoid excessive cam loads and wear, it is desired to balance out all gas pressure loads on the valve by means of a cylinder and piston 29 attached to the upper end of valve stem 30. The top part of piston 29 is acted upon by the same gas pressure that pushes valve 27 up against its seat, which gas pressure is communicated to the opposed balancing piston 29 by means of passage 31 and connecting tubing 32. At the same time, any gas pressure force acting on the back side of valve 27 is balanced by bringing the under side of piston 29 into communication with the gas space above valve 27 by connecting tube 33 and its drilled ports and tube fittings.

With the gas pressure loads thus balanced out of the picture, it becomes feasible to control inlet valve closing by means of a conventional valve spring 34, while its opening is controlled by cam 35, cam follower 36, push-rod 37, tappet 38, and rocker arm 39 engaging the top side of valve spring washer 40.

Similarly, it is necessary to balance out the gas pressure forces acting on the second inlet valve 28. A balancing piston 41 is exposed on its top side of the gas pressure acting on the underside of valve 28 by means of connecting tube 42, and its bottom side is exposed to the top side pressure on valve 28 by means of the connecting tube 43. The opening of valve 28 is controlled by a cam 35' (and its associated valve gear), which is displaced angularly from cam 35 by the angle $\alpha-\theta$, to produce the admission phase angle $\theta$ of FIG. 5.

In working out the balancing cylinder design, it is necessary to insure that the piston-ringed pistons 29 and 41 slide freely in their cylinder bores, and for that reason it is desirable to mount the balancing cylinders on small diameter steel struts 44 on engine cylinder head 45. The lateral flexibility of these struts helps the inlet valve alignment problem by reducing side forces on the valve stems and pistons due to slight misalignment between the valve guides and the cylinder bores.

The engine discharge valve 46 is quite conventional and requires no balancing.

In the engine embodiment described in FIGS. 1,2,3,4 and 5, it has been assumed that the inlet phase angle $\theta$ is fixed in value, and has been selected to match a selected compression and expansion ratio at the point of peak power output. This has been done in the interests of mechanical simplicity and reliability and so that all valves could be operated from one camshaft. The deviation from this optimum value of $\theta$ at lower compression ratios is not large, as can be deducted from FIG. 2. However, if it is required to operate at the optimum $\theta$ at all compression ratios during start up and at part load operation, then it is possible to change $\theta$ automatically with changes in combustor pressure $P_b$ by the means shown in FIG. 6. There the inlet valve cams, such as 35 and 35', are put on separate camshafts 47 and 47'. Camshaft 47 may also have the exhaust valve cams on it. Then camshaft 47' may be rotated relative to camshaft 47 by means of a differential gear drive, like the spur gear differential shown in the figure. This rotation is effected by means of a piston and cylinder 48 which is connected to the combustor pressure $P_b$. The pressured piston moves against the force of biasing spring 49. The motion of piston 48 is transmitted by a piston rod and link 50 to a differential gear frame 51 carrying a pinion 52. Shaft 47 is directly driven from the engine. Its rigidly attached pinion 53 meshes with a gear 54 rigidly attached to shaft 55, which is supported by end bearings 56 and 57. Gear 54 drives pinion 52, which is long enough axially to drive a gear 54' that is free to rotate on its supporting shaft 55. Gear 54' in turn drives pinion 53' that drives camshaft 47'. A displacement of the frame 51 through an angle $\beta$ causes the camshaft 47' to be rotated relative to camshaft 47 by an angle $2\beta$, thereby changing the phase angle $\theta$ by the amount $\Delta\theta=2\beta$. As the peak cycle pressure $P_b$ increases, the angle $\alpha-\theta$ must be increased in order to decrease $\theta$ in FIG. 5, and vice versa. The choice of the biasing spring 49 and/or the piston 48 diameter will determine the amount of phase change $\Delta\theta$ for a given change $\Delta P_b$ in cycle pressure level $P_b$.

The engine is stopped by cutting off its fuel supply by means of either a manual or a switch controlled electric valve in the fuel inlet pipe to the fuel pump 16. This will not disturb the idling speed setting as determined by displacement stops on the cable or rod 17 and its control foot pedal.

Thus it will be seen that I have provided a highly improved heat engine having very high thermal efficiency, nearly perfect combustion with no air pollutants in the exhaust, the ability to burn any fluid fuel, such as crude oil, having means for simply controlling the engine power output, as well as easy starting with a battery energized electric starter motor, and which is extremely quiet in operation because of the absence of explosive combustion, providing, instead, a steady continuous burning of the fuel in a combustion chamber external to the engine cylinders.

While I have illustrated and described a single specific embodiment of my invention, it will be understood that this is by way of illustration only and that various changes and modifications may be contemplated in my invention and within the scope of the following claims.

I claim:

1. A hot gas engine based on the classical Joule cycle and comprising the combination of an air compressor, an external combustor for continuously burning a fluid fuel with the compressed air, a plurality of engine cylinders for expansion of the products of combustion, and a pair of series inlet poppet valves and actuating cams having separate cam shafts per engine cylinder so phased as to provide a short interval period of gas admission to each engine cylinder at different times for making the expansion ratio substantially equal to the compression ratio for maximum thermal efficiency.

2. A hot gas engine as recited in claim 1 together with a differential gear driving said separate cam shafts in response to the combustor pressure for varying the angular intervals of said poppet valves, when they are both open.

3. A hot gas engine as recited in claim 2 wherein said interval is made arbitrarily small by said differential gear without producing destructive high acceleration forces between the valves and their actuating cams.

4. A hot gas engine as recited in claim 2, said combustor comprising an outer pressure vessel with end covers and an inner burner shell attached to one cover of the outer pressure vessel, with the lower end of the burner shell providing a clearance gap with respect to the other cover of the outer pressure vessel for admission of the compressed gas to the combustion zone around the fuel spray nozzle, and with the annular space between the outer pressure vessel and the inner burner shell providing a flow path for regenerative preheating of the compressed gas before it enters the combustion zone and also for cooling the outer pressure vessel; with the length of the gas admission interval to the engine cylinders determining the steady state operating pressure of the combustor, and a fuel pump for said combustor, the engine power output controlled by changing the fuel pump output per revolution.

5. A hot gas engine as recited in claim 1 together with means for counterbalancing the gas pressure forces acting on said inlet poppet valves, so as to permit their actuation by conventional cams and valve gear without excessive cam loads and wear.

6. A hot gas engine based on the classical Joule cycle and comprising the combination of an air compressor, an external combustor for continuously burning a fluid fuel with the compressed air, a plurality of engine cylinders for expansion of the products of combustion, a pair of series inlet cam actuated poppet valves per engine cylinder, a first inlet valve controlling the flow of burned combustion gases into a passage leading to a second inlet valve, said first inlet valve actuated by a cam that is advanced in time and angular phase with respect to an actuating cam for said second inlet valve, the second inlet valve opening after the first inlet valve opens and closing after the first inlet valve closes, the combustion gases admitted to the engine cylinders only when both series inlet valves are open, and means for substantially balancing and equilibrating the gas pressure forces acting on each series inlet valve.

7. A hot gas engine as recited in claim 6, wherein the second inlet poppet valve cam is driven by a camshaft by said hot gas engine at engine crankshaft speed, the first inlet series poppet valve camshaft being driven from the second camshaft at engine crankshaft speed through a differential gear, consisting of a gear-toothed pinion on the second camshaft engaging a gear on an intermediate shaft, said gear meshing with a long pinion engaging also a gear free to rotate on the intermediate shaft, the freely rotatable gear meshing with a pinion keyed to and driving the first inlet valve camshaft, the aforesaid long pinion mounted on a shaft that is supported within a frame that is pivoted on the intermediate shaft, the said frame being adapted to be angularly displaced on the intermediate shaft by the force of a connecting link with an actuating piston subjected to fluid pressure.

8. A hot gas engine, as recited in claim 7, having a pair of said series inlet poppet valves with the piston acting on the differential gear pivoted frame subjected to combustor pressure.

9. Apparatus as recited in claim 8 together with an electric solenoid producing displacement forces on the pivoted differential gear frame.

10. Apparatus as recited in claim 8 with the pivoted differential gear frame subjected to displacement forces produced manually.

11. Apparatus as recited in claim 7 wherein the spur gear differential is replaced by a bevel gear differential.

12. The poppet valve balancing means of claim 6, consisting of a piston mounted on the poppet valve stem and within a cylinder, the end of the piston farthest from the poppet valve stem exposed to the pressure acting on the top surface of the poppet valve by means of a passage that connects the gas chamber over the top of the poppet valve to the cylinder volume above the balancing piston, the end of the balancing piston nearest to the poppet valve stem exposed to the pressure acting on the poppet valve surface at the valve stem by means of a passage that connects the gas chamber on the stem side of the poppet valve with the cylinder volume on the side of the balancing piston connected to the poppet valve stem, said balancing cylinder supported coaxially with the poppet valve stem on struts mounted on the engine cylinder head, said struts being comparatively rigid in the direction of their length and comparatively flexible in bending for error displacements of the balancing cylinder in a direction perpendicular to the poppet valve stem and its guide.

* * * * *